US005542909A

United States Patent [19]

Camp

[11] Patent Number: 5,542,909

[45] Date of Patent: Aug. 6, 1996

[54] WATER JET APPLIANCE

[76] Inventor: Gregory T. Camp, 205 E. 69th St., Apt. 5A, New York, N.Y. 10021

[21] Appl. No.: 219,046

[22] Filed: Mar. 28, 1994

Related U.S. Application Data

[63] Continuation-in-part of Ser. No. 898,110, Jun. 12, 1992, abandoned.

[51] Int. Cl.[6] ..... A61H 9/00

[52] U.S. Cl. ..... 601/160; 601/154; 4/541.3

[58] Field of Search ..... 601/154, 160, 601/161, 167, 168, 84, 159, 169; 239/381; 4/541.3, 559, 492, 541.1; 128/65, 66

[56] References Cited

U.S. PATENT DOCUMENTS

| | | | |
|---|---|---|---|
| 3,801,019 | 4/1974 | Trenary et al. | 239/381 |
| 3,820,173 | 6/1974 | Weller | 601/167 X |
| 4,026,470 | 5/1977 | Crist | 239/381 |
| 4,141,502 | 2/1979 | Grohe | 239/381 |
| 4,282,866 | 8/1981 | Miffitt | 4/541.3 |
| 4,330,089 | 5/1982 | Finkbeiner | 239/381 |
| 4,561,133 | 12/1985 | Laing | 4/492 |
| 4,607,400 | 8/1986 | Goodman | 4/541.3 |
| 4,754,928 | 7/1988 | Rogers et al. | 239/381 |
| 4,957,101 | 9/1990 | Hara | 601/167 X |
| 5,058,220 | 10/1991 | Mikiya | 239/381 |
| 5,195,511 | 3/1993 | Kodato et al. | 601/167 |

FOREIGN PATENT DOCUMENTS

| | | | |
|---|---|---|---|
| 4004801 | 8/1990 | Germany | 601/167 |
| 406142151 | 5/1994 | Japan | 601/107 |

*Primary Examiner*—Sam Rimell
*Assistant Examiner*—Brian E. Hanlon
*Attorney, Agent, or Firm*—Furgang & Milde, LLP

[57] ABSTRACT

A hand-held, self-contained, self-powered, submersible, portable water pump appliance having physical dimensions and weight enabling it to be hand-held and transportable by a person. The appliance can recirculate water in a pool of water, as in a bathtub or spa, and is useful for providing massage and stimulation to the body of a person.

5 Claims, 3 Drawing Sheets

WATER JET APPLIANCE

CROSS-REFERENCE TO RELATED APPLICATION

This application is a continuation-in-part of U.S. patent application Ser. No. 07/898,110, filed Jun. 12, 1992, entitled "WATER JET APPLIANCE", now abandoned.

BACKGROUND OF THE INVENTION

The present invention relates to a portable, self-contained, self-powered, water-submersible water jet appliance useful for providing hydro-massage, enhanced relaxation and other therapeutic benefits.

The use of water sprays and jets for human cleanliness, relaxation and therapy is well known. There are numerous appliances known in the art for providing such sprays and jets. Such appliances can be as simple as an ordinary shower head. Various designs are also known for spas and therapy pools, some of which are now available in sizes that can be used in the home. Generally, however, shower heads, spas and therapy pools provide water sprays and jets from nozzles which, while adjustable over a limited range, are fixed in place. This leads to two distinct disadvantages.

One disadvantage is that, since such appliances are permanently fixed in place and permanently connected to a domestic plumbing system, they cannot conveniently be taken from place to place.

A second disadvantage is that, being fixed in place, such appliances cannot be conveniently used to direct their water jet towards all parts of the body. A person enjoying a spa, for example, can, in a very limited way, adjust his or her body position so that the water jet or spray massages certain preferred areas of the body; however, because the appliance is fixed in place, it is not accessible to all areas of the person's body.

A partial solution of this problem has been provided by a variety of hand-held shower heads. These, however, still suffer from many of the aforesaid limitations. They must be connected to a water source, such as a common water faucet, and must rely on the domestic water system for the amount of water pressure available. They cannot generate their own water pressure. In addition, the water they use is added to the pool already in the bathtub, thereby filling the tub beyond the desired level. This is an inconvenience and a waste of water.

While they can be disconnected and transported, such disconnection and reconnection is not always easily accomplished. A traveler cannot count on the "fittings" at the places he visits being matched to those on his hand-held shower head.

In addition, hand-held shower heads are suitable for projecting a water stream through the air, to impinge or fall upon the human body. They are not, however, generally convenient for use under water. For example, a person sitting in a bathtub full of water could find it inconvenient to use an ordinary hand-held shower head to massage those parts of his or her body that are submerged beneath the water level. Such shower heads are generally cumbersome to move, and lack the flexibility needed to conveniently apply them to all parts of the body.

Still another partial solution to the problem of providing massage and stimulation to a person's body are devices, such as those disclosed in the U.S. Pat. No. 5,195,511 to Kodato et al., which provide a "bubble massage". Such devices aspirate air to produce a stream of water containing tiny bubbles. For this purpose, the air enters the unit through an air line or hose which extends outward to a chamber or the like that is placed in the open air, e.g., outside the bathtub. Because of the necessity for access to air, such devices are not wholly submersible in water and are therefore inconvenient to use as well as transport.

SUMMARY OF THE INVENTION

Accordingly, the principal object of the present invention is to provide a hand-held, self-contained, self-powered, water-submersible, portable water jet appliance that avoids or eliminates the problems and limitations mentioned above.

More particularly, it is an object of the present invention to provide a hand-held self-contained, self-powered, submersible, portable water jet appliance which provides a stream of water that is suitable for both above and completely under-water use in human massage.

These objects, as well as other objects which will become apparent to those skilled in the art, are achieved, in accordance with the present invention, by providing a water jet appliance comprising, in combination, (a) an electric motor, electrically connected to and powered by a battery; (b) a water pump mechanically connected to and powered by the electric motor and having both an inlet port and an outlet port; and (c) a completely submersible housing containing and completely sealing the battery, motor and pump. The housing has openings for the inlet port and outlet port of the pump and, with its contents, has an external physical size and shape, as well as weight, that enable the appliance to be conveniently hand-held when in use and manipulated and transported by a person.

The battery, motor and pump are of such capacity as to eject a water stream from the outlet port which is sufficient for substantial body massage.

In use, the entire apparatus may be completely submerged in water and held in the hand to direct a water stream on any desired part of the body.

Preferably, the battery is rechargeable when the apparatus is not in use.

Furthermore, means may be provided at the outlet port to pulsate the water stream ejected from the apparatus, to adjust the water pressure and flow at the outlet port and/or to adjust the spread of water emerging from the outlet port. Such means may be arranged in a suitable nozzle at the outlet port.

There are many nozzles that can be used in the practice of this invention. Although it is preferred to join the nozzle directly to the outlet of the pump, it is also within the scope of the present invention to join the nozzle to the outlet through a hose. In the preferred embodiment, the nozzle is joined directly to the outlet of the pump, whereby the entire appliance is moved about the body to apply water massage to desired parts of the body. When the hose is used, the person using the appliance would place the appliance in the water, and then manipulate the nozzle around the various parts of the person's body where the action of the water jet was desired.

The nozzle can be provided with a device for pulsating the water or gas/water mixture passed therethrough. The nozzle is preferably adjustable with respect to degree of pulsation, including a range of from no pulsation to full pulsation, and is also adjustable with respect to stream configuration so that the stream can be narrow or widely dispersed such as, for example, a spray. There are a variety of commercially available pulsating shower heads known in the art, and it is within the scope of the present invention to adapt such pulsating devices for use in the water-jet nozzle of the present invention.

The nozzle may be mounted to the outlet through an adjustable mount, such as that used for a common shower head, so that the direction of the water stream from the nozzle can be varied.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
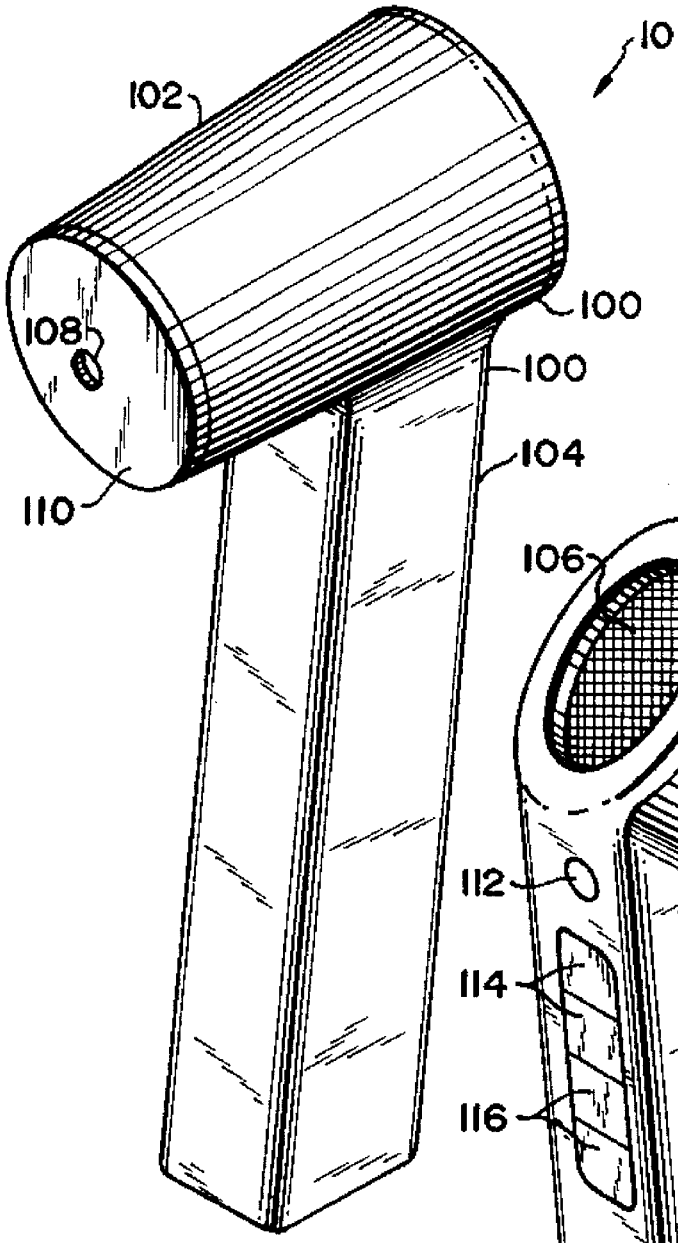
FIG. 1 is a perspective view of one side of a portable water jet appliance according to the principal preferred embodiment of the invention.

The preferred embodiments of the present invention will now be described with reference to FIGS. 1–7 of the drawings. Identical elements in the various figures are designated with the same reference numerals.

Figure 2:
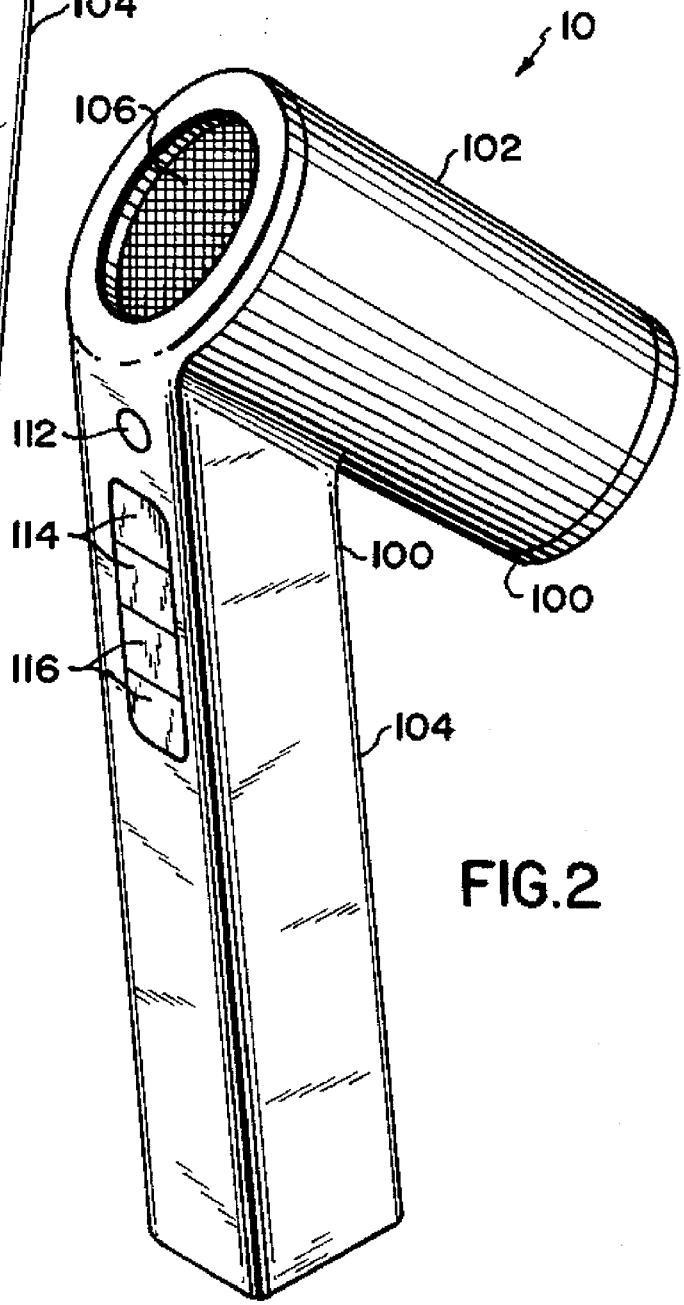
FIG. 2 is a perspective view of the opposite side of the water jet appliance of FIG. 1.

FIGS. 1 and 2 illustrate a hand-held, self-contained, self-powered, submersible, portable water jet appliance according to the principal preferred embodiment of the present invention. This appliance 10 comprises a housing 100 having a head portion 102 and a handle portion 104. The handle 104 contains an electric battery as well as suitable controls and electronics. The head portion 102 contains an electric motor, electrically connected to and powered by the battery, and a water pump, mechanically connected to and powered by the motor. The housing has a water inlet 106 and a water outlet 108. Associated with the outlet 108 is a dial 110 for adjusting the width of the flow opening.

Arranged on the back of the handle are a battery indicator light 112, flow and pressure adjustment (including on/off) switches 114 and switches 116 to control the presence and speed of pulsation.

Figure 3:
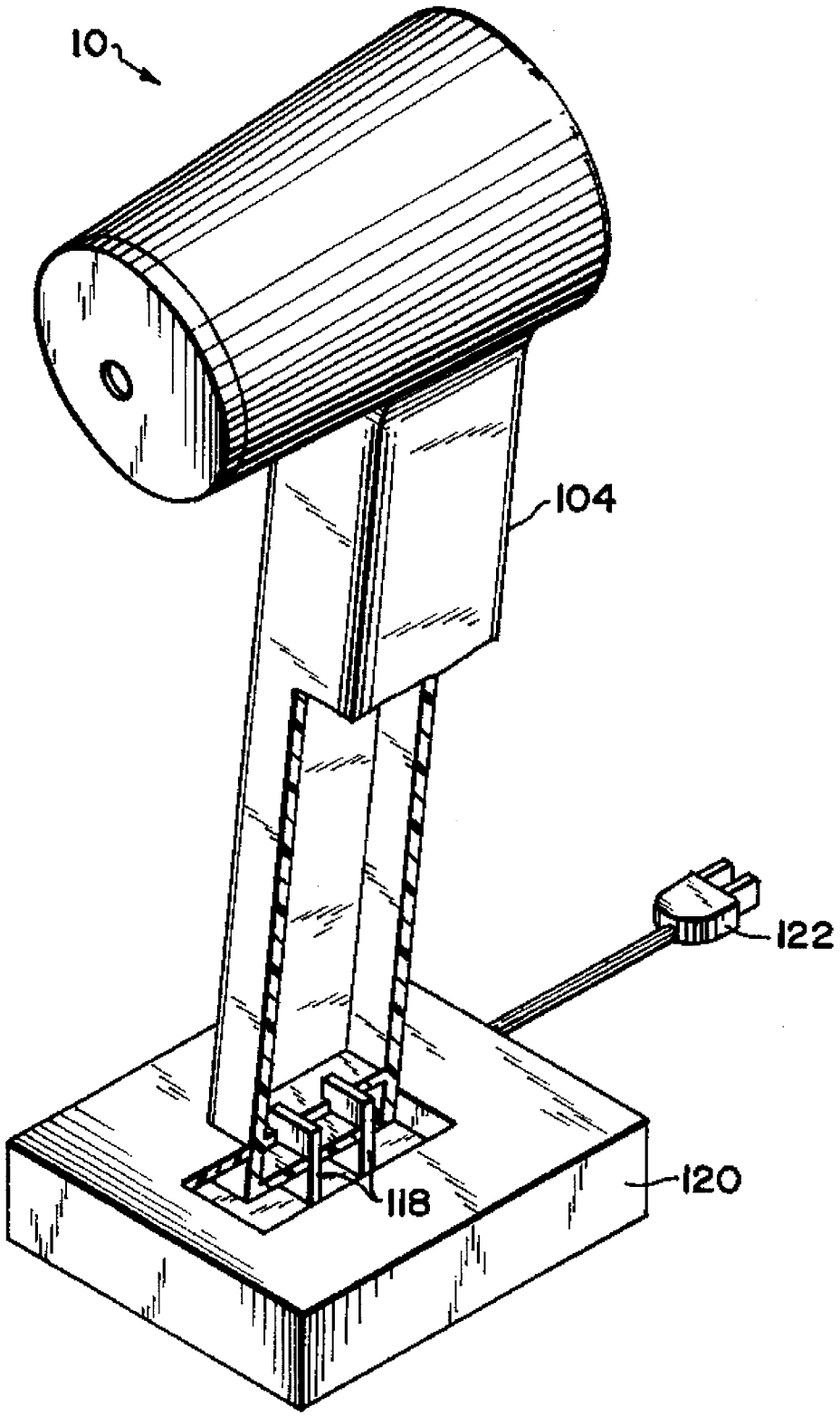
FIG. 3 is a perspective and partially cut-away view of the water jet appliance of FIG. 1 placed on a recharger unit.

As shown in FIG. 3, the base of the handle portion 104 which forms the battery compartment, includes a plug 118 that plugs into a recharger unit 120. This recharger unit comprises a transformer, rectifier and other necessary electronics for converting 110 volt AC received from a standard wall plug 122 into 12 or 24 volt DC current suitable for charging the battery.

If desired, inlet and outlet "nipples" may be placed at the water inlet 106 and/or water outlet 108 to permit the attachment of a flexible hose.

In any case, the housing 100 of the water jet appliance 10 is completely submersible and, with its contents, has an external physical size and shape, as well as weight, that enable the appliance to be conveniently hand-held when in use and manipulated and transported by a person.

Therefore, when in use, the entire apparatus is preferably completely submerged in water and held in tile hand to direct a water stream on any desired part of the body. The battery, motor and pump receive water through the water inlet port 106 and eject water through the outlet port 108 with such quantity and flow rate as to be sufficient for substantial body massage.

Figure 4:
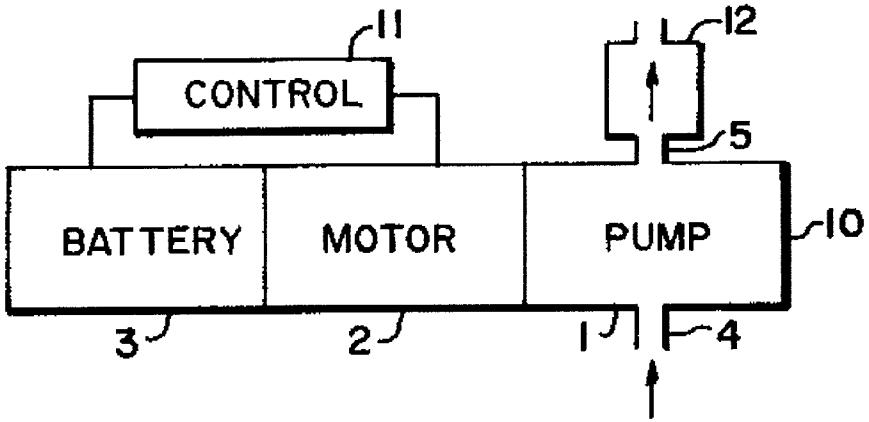
FIG. 4 is a schematic diagram of the operative elements of the portable water jet appliance of FIG. 1.

The operative elements of the portable water jet appliance according to the present invention are depicted schematically in FIG. 4. As shown in this figure, pump 1 is driven by an electric motor 2 which is supplied with electricity from a battery 3 through a control device (e.g., speed control) 11. The battery 3 can be either a dry cell battery or a rechargeable battery, although a rechargeable battery is preferred.

When the entire appliance 10 is submerged in water and turned on, battery 3 supplies electricity to motor 2 which causes the driveshaft of the motor 2 to rotate. The driveshaft is mechanically connected to the pump 1 so that pump 1 is thereby operated. The inlet 106 then draws water from the surrounding pool of water (not shown) into the pump 1, and discharges it through the outlet 108. Outlet 108 can be joined to a hose (not shown) which is equipped with a nozzle (not shown) at the other end or, preferably, outlet 108 is joined directly to an adjustable nozzle or pulsating device 12 to provide a pulsating water jet.

The entire appliance 10 is small enough and light enough in weight so that it can be held in the hand of a person and moved about under water to direct the discharge of water from the outlet 108, or a nozzle joined to outlet 108, to impinge upon the desired parts of the body.

There are various types of pumps that can be used for the pump 1. Such types include, but are not limited to, centrifugal, turbine and diaphragm pumps. The pumps can be constructed of various materials known to those skilled in the art, such as carbon steel, stainless steel, brass and plastic.

It is important that the pump generate sufficient pressure to provide the person using it with a satisfactory massage or stimulation. Generally, the pressure generated ranges from about 20 inches of water to about 200 inches of water and is adjustable within this range. The flow rate of the water discharged from the outlet of the pump generally ranges from about 5 pounds per minute to about 60 pounds per minute and is adjustable within this range.

Figure 5:
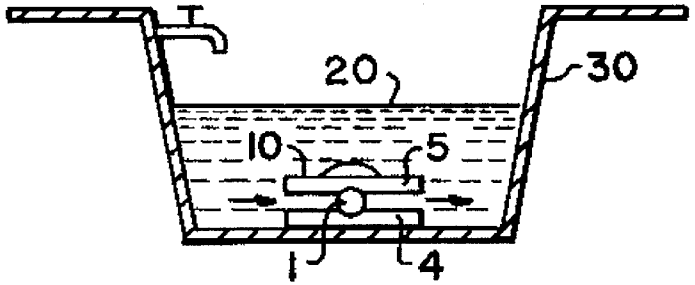
FIG. 5 is a representational diagram of the water jet appliance of FIG. 1 submerged beneath water in a bathtub.

In FIG. 5, the appliance 10 is completely submerged beneath the water 20 in a bathtub 30.

Figure 6:
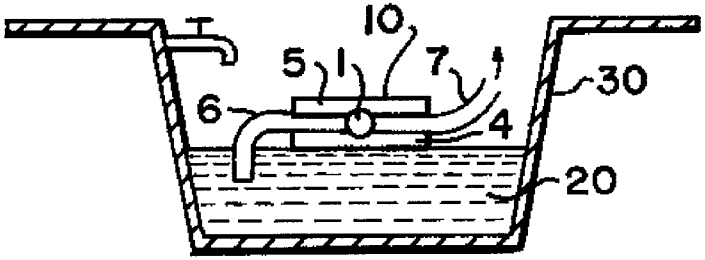
FIG. 6 is a representational diagram of the water jet appliance of FIG. 1 floating on the surface of water in a bathtub and having an intake hose submerged beneath the water level and an outlet hose.

In FIG. 6, the appliance 10 is adapted to float on the surface of the water 20, for example the aid of a styrofoam "base", with the inlet 106 joined to a hose 6, which is disposed beneath the level of water 20. In use, the water 20 is drawn up through the hose 6 to the inlet 106 of the pump 1, whereupon it is discharged from the pump 1 through an outlet 108 to a discharge hose 7.

Figure 7:
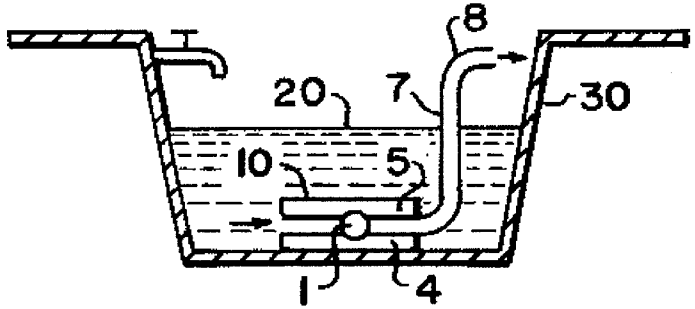
FIG. 7 is a representational diagram of the water jet appliance of FIG. 1 submerged beneath the surface of water in a bathtub and having a discharge hose with a nozzle.

In FIG. 7, the appliance is beneath the water surface, but the discharge hose 7 is above the water surface.

In the practice of this invention, it is contemplated that the portable water jet appliance will be used by a person while taking a bath in a bathtub. It is also contemplated that such a person may prefer to use the appliance in conjunction with discharge hose 7 rather than to hold the entire appliance in hand. It may, under such circumstances, be desirable to temporarily affix the appliance to a single position within the bathtub, which position could be either above or below the water surface. Accordingly, it is within the scope of the present invention to provide suction cups on the appliance, by which the appliance can be attached to the wall or floor of the bathtub.

There has thus been shown and described a novel water jet appliance which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Hand-held, self-contained, self-powered, submersible, portable water jet apparatus comprising, in combination:

(a) an electric battery;

(b) an electric motor, electrically connected to and powered by said battery;

(c) a water pump mechanically connected to and powered by said motor and having an inlet port adapted to draw in surrounding water and an outlet port; said battery, motor and pump being of such capacity as to eject a water stream from said outlet port sufficient for substantial body massage; and (d) a completely submersible housing containing and completely enclosing said battery, motor and pump, said housing including a head portion having openings for said inlet port and outlet port and containing said motor and pump, said housing with its contents, having an external physical size and shape as well as a weight that enable said apparatus to be conveniently hand-held when in use and manipulated and transported by a person, said housing further having an elongate handle portion with two ends, said head portion being rigidly, immovably attached to one end of said handle portion, the other end of said handle portion being unattached to said head portion and extending outward in a direction away from said head portion, said handle portion having a shape which permits it to be conveniently gripped and held by at least one hand of a user so that said housing may be oriented in any desired manner;

wherein during use the inlet port of the apparatus is completely submerged and the outlet port is directed toward the user's body;

whereby the apparatus may be completely submerged in water and held in the hand to direct a water stream on any desired part of the body.

2. The apparatus of claim 1, wherein said battery is a rechargeable battery.

3. The apparatus of claim 1, further comprising pulsating means for pulsating the water stream.

4. The apparatus of claim 1, further comprising means for adjusting the water pressure and flow at said outlet port.

5. The apparatus of claim 1, further comprising means, arranged at said outlet port, for adjusting the spread of water emerging from said outlet port.

* * * * *